United States Patent [19]

Fujii

[11] Patent Number: 4,840,665

[45] Date of Patent: Jun. 20, 1989

[54] WEAR-RESISTANT SINTERED IRON-BASED ALLOY AND PROCESS FOR PRODUCING THE SAME

[75] Inventor: Satoshi Fujii, Hyogo, Japan

[73] Assignee: Sumitomo Electric Industries, Ltd., Osaka, Japan

[21] Appl. No.: 3,342

[22] Filed: Jan. 14, 1987

[30] Foreign Application Priority Data

Jan. 14, 1986 [JP] Japan ..... 61-6934

[51] Int. Cl.[4] ..... C22C 29/02

[52] U.S. Cl. ..... 75/241; 75/240

[58] Field of Search ..... 75/239, 240, 241

[56] References Cited

U.S. PATENT DOCUMENTS

| | | | |
|---|---|---|---|
| 3,525,607 | 8/1970 | Holtz, Jr. | 75/239 |
| 4,194,910 | 3/1980 | Mal et al. | 75/239 |
| 4,345,942 | 8/1982 | Takahashi et al. | 75/241 |
| 4,345,943 | 8/1982 | Takahashi et al. | 75/241 |
| 4,360,383 | 11/1982 | Takahashi et al. | 75/239 |
| 4,702,771 | 10/1987 | Takagi et al. | 75/241 |

OTHER PUBLICATIONS

Henderson, *Metallurgical Dictionary,* 1953, pp. 203–204.

*Primary Examiner*—Stephen J. Lechert, Jr.
*Assistant Examiner*—Eric Jorgensen
*Attorney, Agent, or Firm*—Sughrue, Mion, Zinn, Macpeak & Seas

[57] ABSTRACT

A wear-resistant sintered iron-based alloy and a process for producing the alloy are described, wherein the alloy comprises a first phase having a martensite composition which comprises from 0.5 to 3.0 wt % of Cr, from 0.4 to 1.0 wt % of Mn, from 0.1 to 0.4 wt % of Mo, and the balance of Fe, based on the total amount of said first phase; a second phase having a martensite and Cr carbide composition which comprises from 10 to 20 wt % of Cr and the balance of Fe, based on the total amount of said second phase; and from 1.0 to 2.5 wt % of C, based on the total amount of said alloy; wherein said first phase and said second phase are present as a mixture containing from 10 to 80% by volume of said second phase, based on the total volume of said alloy; and said alloy is substantially free from any residual austenite.

2 Claims, No Drawings

WEAR-RESISTANT SINTERED IRON-BASED ALLOY AND PROCESS FOR PRODUCING THE SAME

FIELD OF THE INVENTION

The present invention relates to a sintered iron-based alloy which has superior wear resistance and is useful e.g., as a material for vanes in a rotary compressor pump. The present invention also relates to a process for producing such an improved alloy.

BACKGROUND OF THE INVENTION

Vanes in rotary compressor pumps in current use are formed of specialty cast iron or high-speed cutting steel, but vanes made of these materials are very expensive because it is required to machine the entire vane structure.

In certain applications, vanes formed of sintered materials are being used. In spite of the low cost of these vanes, the presence of residual austenite structure due to the presence of nickel makes them unsuitable for use in high-load pumps because of their poor performance in wear resistance and seizure resistance.

Iron and steel materials can be provided with improved wear resistance by performing quenching and tempering. However, attempts to apply these heat treatments to sintered alloys have not met with much success because of insufficient real pressure due to the presence of pores in the sintered alloys.

SUMMARY OF THE INVENTION

An object, therefore, of the present invention is to provide a sintered iron-based alloy which has surriciently high wear resistance and seizure resistance to be useful as a material for vanes in a rotary compressor pump.

Another object of the present invention is to provide a process for producing such an improved iron-based alloy.

The wear-resistance sintered iron-based alloy according to one aspect of the present invention comprises a first phase having a martensite composition which comprises from 0.5 to 3.0 wt % of Cr, from 0.4 to 1.0 wt % of Mn, from 0.1 to 0.4 wt % of Mo, and the balance of Fe, based on the total amount of said first phase;

a second phase having a martensite and Cr carbide composition which comprises from 10 to 20 wt % of Cr and the balance of Fe, based on the total amount of said second phase; and from 1.0 to 2.5 wt % of C, based on the total amount of said alloy;

wherein said first phase and said second phase are present as a mixture containing from 10 to 80% by volume of said second phase, based on the total volume of said alloy; and said alloy is substantially free from any residual austenite.

The sintered alloy having the characteristics described above can be produced by a process comprising the steps of mixing a powder mixture comprising (1) from 10 to 80 wt % based on the total amount of said powder mixture of an alloy powder comprising from 10 to 20 wt % of Cr and the balance of Fe, based on said alloy powder; (2) from 1.0 to 2.5 wt % based on the total amount of said powder mixture of carbon powder; and (3) the balance based on the total amount of said powder mixture of alloy powder or mixed powder comprising from 0.5 to 3.0 wt % of Cr, from 0.4 to 1.0 wt % of Mn, from 0.1 to 0.4 wt % of Mo, and the balance of Fe, based on the total amount of said alloy powder or mixed powder;

compressing and molding said powder mixture thus obtained;

sintering the molded mixture at a temperature of from 1,100° to 1,250° C. under vacuum or under an inert gas atmosphere;

cooling to room temperature;

heating again to a temperature of from 820° to 950° C. the sintered product;

quenching; and tempering the same.

DETAILED DESCRIPTION OF THE INVENTION

According to the preferred embodiment of the present invention, the first phase further comprises from 0.3 to 3.0 wt % based on the total amount of said first phase of at least one of W, V, and Nb which is present as a carbide, and said second phase further comprises from 0.3 to 3.0 wt % based on the total amount of the second phase of at least one of W, V, and Nb which is present as a carbide.

In the process according to the present invention, the powder mixture further comprises from 0.3 to 3.0 wt % based on the total amount of said powder mixture of at least one metal powders of W, V, and Nb.

If at least one of W, V and Nb is incorporated in the powder mixture in an amount ranging from 0.3 to 3.0 wt %, a carbide thereof forms in the sintered product and is dispersed uniformly within the first and second phase so as to achieve further improvement in the wear resistance of the sintered alloy.

The sintered alloy having the composition specified above can be substantially freed of any residual austenitic composition by the final steps of quenching and tempering. The steps following the sintered step preferably comprise cooling to room temperature, heating again to a temperature of from 820° to 950° C. the sintered product, maintaining at such temperature for about 60 minutes, quenching, and tempering the same.

The tempering step is preferably performed by reheating to a temperature of from 180° to 450° C. for about 60 minutes.

In the process of the present invention, the aforementioned Fe-Cr alloy powder must be used in an amount of from 10 to 80 wt % based on the total amount of the alloy of the present invention. If the content of this alloy powder is less than 10 wt %, sintered alloy having adequate wear resistance is not obtainable. If the content of the Fe-Cr alloy powder exceeds 80 wt %, the resulting sintered alloy is so hard that when used as a sliding material it will cause rapid wear of the mating material against which it is to slide.

Sintering must be effected either in vacuum or in an inert gas atmosphere. If an oxidative atmosphere is employed, easily oxidizable elements such as Mn and Cr present in the powder mixture will be oxidized. If an ammonia decomposition gas or hydrogen gas is used, decarburization will occur, to increase the chance of creating a nonuniform alloy structure.

The sintered alloy produced in accordance with the present invention has superior wear resistance, and this may be explained by the following two reasons: (1) the alloy contains hard components such as a Cr carbide and an optionally present W, V or Nb carbide; and (2) the alloy has substantially no residual austenite in its structure.

The following examples are provided for the purpose of further illustrating the present invention but are in no sense to be taken as limiting.

EXAMPLE 1

Eight powder mixtures having the compositions shown in Table 1 were processed by the steps shown below in order to produce eight samples of sintered alloy. The starting powders in each mixture were well blended, compressed and molded at a pressure of about from 4 to 6 tons/cm$^2$, and then sintered at a temperature of from 1,100° to 1,250° C. in vacuum. The resulting sintered alloy was held at a temperature of from 820° to 900° C. for 60 minutes, oil-quenched, and subsequently tempered at 400° C. for 60 minutes.

TABLE 1

| Sample No. | Alloy powder A (wt %) | Alloy powder B (wt %) | Mixed powder (wt %) | Carbon powder (wt %) |
|---|---|---|---|---|
| 1 | 5 | balance | — | 1.5 |
| 2 | 10 | balance | — | 1.5 |
| 3 | 20 | balance | — | 1.5 |
| 4 | 50 | balance | — | 1.5 |
| 5 | 80 | balance | — | 1.5 |
| 6 | 90 | balance | — | 1.5 |
| 7 | 20 | — | balance | 1.5 |
| 8 | 50 | — | balance | 1.5 |

Notes:

(1) Alloy powder A was composed of 13 wt % of Cr and the balance of Fe.

(2) Alloy powder B was composed of 1 wt % of Cr, 0.7 wt % of Mn, 0.3 wt % of Mo, and the balance of Fe.

(3) Mixed powder was composed of 2 wt % of Ni and the balance of Fe.

The compositions of the first and second phases in each sample were analyzed by electron probe micro analizer (EPMA) and shown in Table 2 in terms of wt %. The area coverage (%) of the second phase in each sample was determined by observation of its cross section, and the results are also shown in Table 2. In Table 2, "bal." means the balance.

TABLE 2

| Sample | First phase | | | | | Second phase | | Area coverage of second phase |
|---|---|---|---|---|---|---|---|---|
| No. | Fe | Cr | Mn | Mo | Ni | Fe | Cr | (%) |
| 1 | bal. | 1.0 | 0.7 | 0.2 | — | bal. | 13 | 5 |
| 2 | bal. | 0.9 | 0.6 | 0.2 | — | bal. | 13 | 10 |
| 3 | bal. | 0.9 | 0.7 | 0.3 | — | bal. | 12 | 20 |
| 4 | bal. | 1.0 | 0.6 | 0.3 | — | bal. | 13 | 50 |
| 5 | bal. | 1.0 | 0.6 | 0.3 | — | bal. | 13 | 80 |
| 6 | bal. | 0.9 | 0.7 | 0.2 | — | bal. | 13 | 90 |
| 7 | bal. | 1.0 | — | — | 1.8 | bal. | 12 | 20 |
| 8 | bal. | — | — | — | 1.9 | bal. | 13 | 50 |

Each of the samples obtained was in a cylindrical form having a diameter of 5 mm and a length of 10 mm. A wear test was conducted with this cylinder being used as a fixed test piece. The mating member was formed of heat-treated meehanite cast iron (hardness =49 in $H_RC$) and measured 46 mm in outside diameter, 20 mm in inside diameter, and 10 mm in length. While this member was caused to rotate, the fixed test piece was urged against it at a load of 100 kg, with lubrication being effected by spraying a refrigerator oil onto the sliding area at a rate of 200 cc/min. The amount of wear in the fixed test piece was measured after conducting the test at a sliding speed of 1 m/sec for 20 hours. The results are shown in Table 3 together with the amount of residual austenite (as measured by X-ray diffraction).

TABLE 3

| Sample No. | Wear (mm$^3$) | Residual austenite (%) |
|---|---|---|
| 1 | 1.0 | 0 |
| 2 | 0.6 | 0 |
| 3 | 0.6 | 0 |
| 4 | 0.5 | 0 |
| 5 | 0.4 | 0 |
| 6 | 0.4 | 0 |
| 7 | 1.4 | 12 |
| 8 | 1.25 | 10.5 |

Sample Nos. 2 to 5 which were prepared in accordance with the present invention displayed satisfactory wear resistance, but comparative sample Nos. 1, 7, and 8 wore by very large amounts. Sample No. 6 containing large amounts of the hard components which acted as abrasive materials caused rapid wear in the mating member.

EXAMPLE 2

Five powder mixes having the compositions shown in Table 4 were processed in the same manner as in Example 1 to produce fine samples of sintered alloy.

TABLE 4

| Sample No. | Alloy powder A (wt %) | Alloy powder B (wt %) | Mixed powder (wt %) | Carbon powder (wt %) | W powder (wt %) |
|---|---|---|---|---|---|
| 9 | 10 | balance | — | 1.5 | 2 |
| 10 | 20 | balance | — | 1.5 | 2 |
| 11 | 50 | balance | — | 1.5 | 2 |
| 12 | 80 | balance | — | 1.5 | 2 |
| 13 | 50 | — | balance | 1.5 | 2 |

Notes: Alloy powder A, Alloy powder B, and the Mixed powder had the same compositions as used in Example 1.

The compositions of the first and second phases in each sample were analyzed by EPMA and shown in Table 5 in terms of wt %. The area coverage (%) of the second phase in each sample was determined by observation of its cross section and the results are also shown in Table 5. The indication of the Fe content in each of the first and second phase is omitted from Table 5.

TABLE 5

| Sample | First phase | | | | | Second phase | | Area coverage of second phase |
|---|---|---|---|---|---|---|---|---|
| No. | W | Cr | Mn | Mo | Ni | W | Cr | (%) |
| 9 | 2.0 | 1.0 | 0.7 | 0.3 | — | 2.0 | 13 | 10 |
| 10 | 2.0 | 1.1 | 0.6 | 0.2 | — | 2.0 | 13 | 20 |
| 11 | 2.0 | 0.9 | 0.7 | 0.2 | — | 2.1 | 12 | 50 |
| 12 | 1.9 | 1.0 | 0.7 | 0.3 | — | 2.0 | 13 | 80 |
| 13 | 2.0 | — | — | — | 1.9 | 2.0 | 12 | 50 |

Each of the samples obtained was subjected to a wear test in the same manner as in Example 1 except that the mating member which was caused to rotate while the samples were held in sliding contact therewith was formed of a Ni-Mo-Cr cast iron ($H_RC$=55), which is harder than that used in Example 1. The test results are shown in Table 6.

X-ray diffraction indicated that no residual austenite was detectable in any of the samples tested, except sample No. 13 which was found to contain 10% residual austenite.

TABLE 6

| Sample No. | Wear ($mm^3$) |
|---|---|
| 9 | 0.60 |
| 10 | 0.55 |
| 11 | 0.50 |
| 12 | 0.45 |
| 13 | 1.25 |

Sample Nos. 9 to 12 which were prepared in accordance with the present invention indicated satisfactory wear resistance, but comparative sample No. 13 wore by a large amount.

As described in the foregoing pages, the present invention enables the production of a sintered iron-based alloy at low cost; the sintered alloy is prepared from a Ni-free powder mix so that it has no residual austenite present; in addition, the alloy contains a rigid Cr carbide which contributes to imparting superior resistance to wear and seizure. The sintered alloy of the present invention is useful as a material of sliding members, particularly vanes in a rotary compressor pump. The wear resistance of the alloy can be further improved by incorporation of W, V, or Nb.

While the invention has been described in detail and with reference to specific examples thereof, it will be apparent to one skilled in the art that various changes and modifications can be made therein without departing from the spirit and scope thereof.

What is claimed is:

1. A wear-resistant sintered iron-based alloy consisting essentially of a first phase having a martensite composition which comprises from 0.5 to 3.0 wt % of Cr, from 0.4 to 1.0 wt % of Mn, from 0.1 to 0.4 wt % of Mo, and the balance of Fe, based on the total amount of said first phase;

a second phase having a martensite and Cr carbide composition which comprises from 10 to 20 wt % of Cr and the balance of Fe, based on the total amount of said second phase; and from 1.0 to 2.5 wt % of C, based on the total amount of said alloy;

wherein said first phase and said second phase are present as a mixture containing from 10 to 80% by volume of said second phase, based on the total volume of said alloy; and said alloy is substantially free from any residual austenite.

2. A wear resistant sintered iron-based alloy as in claim 1, wherein said first phase further comprises from 0.3 to 3.0 wt % based on the total amount of said first phase of at least one of W, V, and Nb which is present as a carbide, and said second phase further comprises from 0.3 to 3.0 wt % based on the total amount of said second phase of at least one of W, V, and Nb which is present as a carbide.

* * * * *